US010591265B2

(12) United States Patent
Smith

(10) Patent No.: US 10,591,265 B2
(45) **Date of Patent: *Mar. 17, 2020**

(54) NON-JACKETED EXPANDABLE BULLET AND METHOD OF MANUFACTURING A NON-JACKETED EXPANDABLE BULLET

(71) Applicant: Continuous Metal Technology, Inc., Ridgway, PA (US)

(72) Inventor: Timothy G. Smith, St. Marys, PA (US)

(73) Assignee: Continuous Metal Technology, Inc., Ridgway, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/269,042

(22) Filed: Feb. 6, 2019

(65) Prior Publication Data

US 2019/0170489 A1 Jun. 6, 2019

Related U.S. Application Data

(63) Continuation of application No. 15/407,047, filed on Jan. 16, 2017, now Pat. No. 10,209,045.

(60) Provisional application No. 62/279,082, filed on Jan. 15, 2016.

(51) Int. Cl.

| | |
|---|---|
| ***F42B 12/00*** | (2006.01) |
| ***F42B 12/34*** | (2006.01) |
| ***F42B 12/74*** | (2006.01) |

(52) U.S. Cl.

CPC ..... *F42B 12/34* (2013.01); *F42B 12/74* (2013.01)

(58) Field of Classification Search

CPC ..... F42B 12/34; F42B 12/367

See application file for complete search history.

(56) References Cited

U.S. PATENT DOCUMENTS

| | | | | |
|---|---|---|---|---|
| 2,409,307 | A * | 10/1946 | Patch | F42B 12/74 102/516 |
| 5,127,332 | A * | 7/1992 | Corzine | F42B 12/34 102/509 |
| 5,877,437 | A * | 3/1999 | Oltrogge | B22F 1/0003 75/228 |
| 5,945,629 | A * | 8/1999 | Schildknecht | F42B 12/204 102/273 |
| 6,546,875 | B2 | 4/2003 | Vaughn et al. | |
| 6,629,485 | B2 | 10/2003 | Vaughn et al. | |
| 8,312,815 | B1 * | 11/2012 | Joys | C22C 1/0425 102/506 |
| 9,702,679 | B2 * | 7/2017 | Smith | F42B 12/74 |
| 2004/0016356 | A1 * | 1/2004 | Jopson | F42B 7/08 102/506 |

(Continued)

FOREIGN PATENT DOCUMENTS

| | | | |
|---|---|---|---|
| FR | 2364427 | A1 | 4/1978 |

*Primary Examiner* — Gabriel J. Klein

(74) *Attorney, Agent, or Firm* — The Webb Law Firm

(57) ABSTRACT

A non-jacketed expandable bullet including a monolithic sintered body. The monolithic sintered body includes a base portion and a deformed hollow nose portion extending distally from a distal end of the base portion. Also, a method of manufacturing a non-jacketed expandable bullet including providing a monolithic sintered body including a base portion and a hollow peripheral portion extending distally from a distal end of the base portion and forming the hollow peripheral portion into the shape of a hollow tapered nose.

20 Claims, 12 Drawing Sheets

(56) References Cited

U.S. PATENT DOCUMENTS

2004/0244629 A1* 12/2004 Jopson ..... F42B 12/34
102/508
2015/0330751 A1* 11/2015 Flint ..... F42B 12/367
102/507

* cited by examiner

NON-JACKETED EXPANDABLE BULLET AND METHOD OF MANUFACTURING A NON-JACKETED EXPANDABLE BULLET

CROSS REFERENCE TO RELATED APPLICATION

This application claims priority to U.S. patent application Publication Ser. No. 15/407,047 filed on Jan. 16, 2017, which claims priority to U.S. Provisional Application No. 62/279,082 filed on Jan. 15, 2016, the disclosures of which is hereby incorporated by reference in their entireties.

BACKGROUND OF THE INVENTION

Field of the Invention

The invention relates generally to non-jacketed expandable bullets, and in particular, to non-jacketed expandable bullets capable of being manufactured from lead-free materials, as well as methods of manufacturing such non-jacketed expandable bullets.

Description of Related Art

The use of lead-based ammunition has been increasingly regulated in many states and countries. New, more restrictive lead bans have placed an emphasis on developing new lead-free projectiles and ammunition that represent cost-effective alternatives as compared to those that are presently available. In some cases, the implementation of regulations may be conditioned on the availability of cost-effective alternatives to lead-free projectiles.

SUMMARY OF THE INVENTION

The present invention is directed to an improved non-jacketed expandable bullet and a method of manufacturing such a bullet. In one preferred and non-limiting embodiment or aspect, the improved non-jacketed expandable bullet and the method of manufacturing the bullet address and/or overcome certain deficiencies and drawbacks associated with existing bullets and manufacturing processes by providing more efficient use of raw materials and/or reducing the number and/or difficulty of the processing steps in order to provide a cost-effective alternative to lead-based ammunition.

In one non-limiting embodiment or aspect, the invention is directed to a non-jacketed expandable bullet, comprising a monolithic sintered body comprising a base portion having a proximal end and a distal end and a deformed hollow nose portion extending distally from the distal end of the base portion.

In one non-limiting embodiment or aspect, the deformed hollow nose portion comprises a proximal end, a distal end, and a sidewall between the proximal end and the distal end. In one non-limiting embodiment or aspect, the sidewall defines an internal cavity and at least a portion of an inner surface of the internal cavity tapers inwardly in a direction extending from the proximal end of the deformed hollow portion toward the distal end of the deformed hollow portion. In one non-limiting embodiment or aspect, the sidewall defines an internal cavity and at least a portion of an inner surface of the internal cavity tapers outwardly in a direction extending from the proximal end of the deformed hollow portion toward the distal end of the deformed hollow portion.

In one non-limiting embodiment or aspect, the monolithic sintered body may be lead free.

In one non-limiting embodiment or aspect, the monolithic sintered body may include at least one of copper, nickel, tin, zinc, or any combination thereof.

In one non-limiting embodiment or aspect, the monolithic sintered body may be made from copper or a copper-based alloy. In one non-limiting embodiment or aspect, the copper-based alloy may include at least 70% copper. In one non-limiting embodiment or aspect, the copper-based alloy may include at least one of nickel, tin, zinc, or any combination thereof.

In one non-limiting embodiment or aspect, the invention is directed to ammunition comprising a non-jacketed expandable bullet according to one or more of the embodiments or aspects described above and a cartridge casing holding the non-jacketed expandable bullet.

In one non-limiting embodiment or aspect, the present invention is directed to a method of manufacturing a non-jacketed expandable bullet, the method comprising providing a monolithic sintered body a base portion having a proximal end and a distal end and a hollow peripheral portion extending distally from the distal end of the base portion and forming the hollow peripheral portion into the shape of a hollow tapered nose.

In one non-limiting embodiment or aspect, the provision of the monolithic sintered body may comprise providing a compacted powder preform a base portion having a proximal end and a distal end and a hollow peripheral portion extending distally from the distal end of the base portion and sintering the compacted powder preform.

In one non-limiting embodiment or aspect, the provision of the compacted powder preform comprises providing powder to a cavity formed in a die between at least an upper punch and a lower punch and pressing the upper and lower punches together to compact the powder.

In one non-limiting embodiment or aspect, the hollow peripheral portion comprises a first end, a second end, and a sidewall between the first end and the second end. In one non-limiting embodiment or aspect, the sidewall defines an internal cavity and at least a portion of the internal cavity may have a transverse cross-section that is one of triangular, square, hexagonal, or octagonal.

The non-jacketed expandable bullet produced according to the method may have any of the aspects described above.

The present invention is neither limited to nor defined by the above summary. Rather, reference should be made to the claims for which protection is sought with consideration of equivalents thereto.

DESCRIPTION OF THE INVENTION

Unless otherwise indicated, each numerical parameter in the specification and claims should be construed in light of the number of reported significant digits and by applying ordinary rounding techniques. Also, it should be understood that any numerical range recited herein is intended to include all sub-ranges subsumed therein. For example, a range of "1 to 10" is intended to include all sub-ranges between the recited minimum value of 1 and the recited maximum value of 10. All compositions are given in weight percent unless specifically stated otherwise.

It is to be understood that the invention may assume various alternative variations and step sequences, except where expressly specified to the contrary. It is also to be understood that the specific products, systems, and processes illustrated in the attached drawings, and described in the following specification, are simply exemplary embodiments of the invention. Hence, specific dimensions and other physical characteristics related to the embodiments disclosed herein are not to be considered as limiting. As used in the specification and the claims, the singular form of "a", "an", and "the" include plural referents unless the context clearly dictates otherwise.

Figure 1:
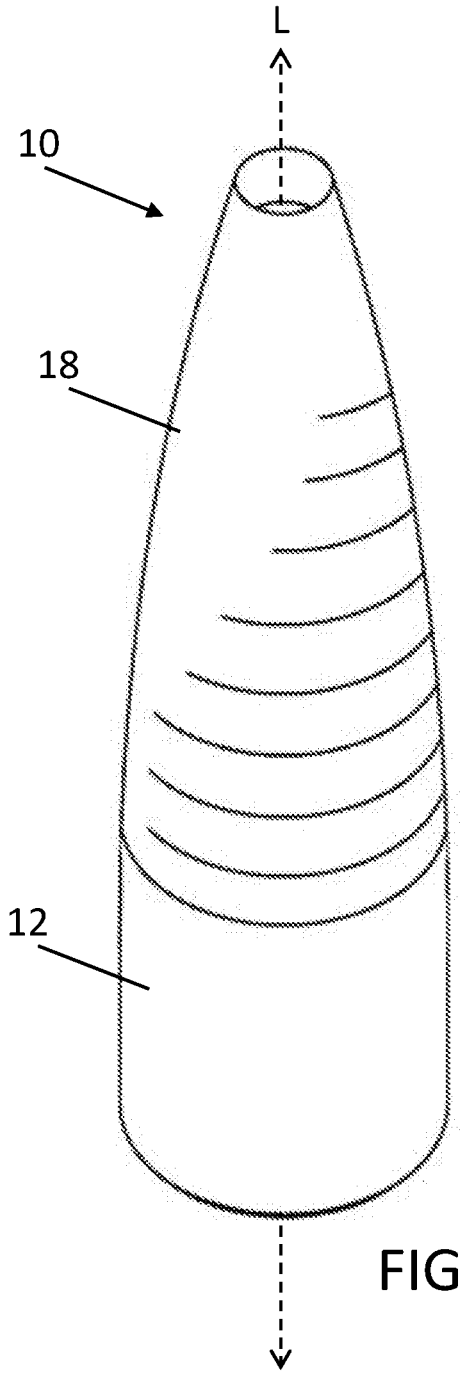
FIG. 1 is a perspective view of a non-jacketed expandable bullet according to a non-limiting embodiment or aspect of the present invention.

The present invention is directed to a non-jacketed expandable bullet. FIG. 1 illustrates a perspective view of a non-jacketed expandable bullet according to a non-limiting embodiment or aspect of the present invention, and FIG. 2 illustrates a sectional perspective view of the non-jacketed expandable bullet of FIG. 1.

Figure 2:
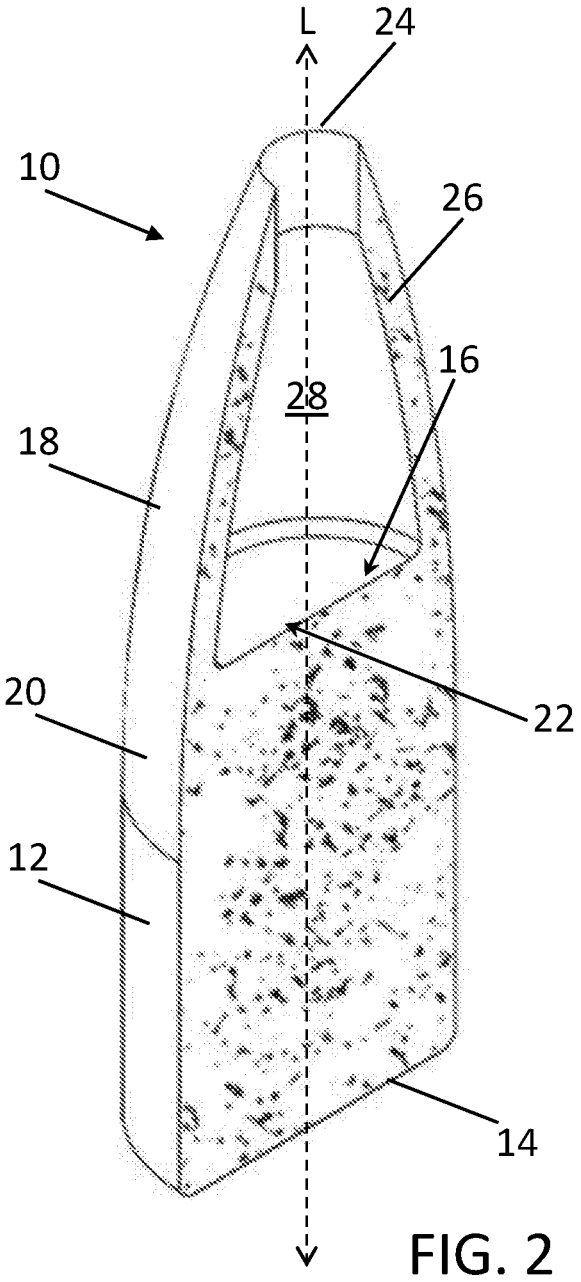
FIG. 2 is a sectional perspective view of the non-jacketed expandable bullet of FIG. 1.

As illustrated in FIGS. 1 and 2, and in one non-limiting embodiment or aspect, the non-jacketed expandable bullet comprises a monolithic sintered body 10. The monolithic sintered body 10 may include a base portion 12 having a proximal end 14 and a distal end 16 and a hollow nose portion 18 extending distally from the distal end of the base portion 12.

In one non-limiting embodiment or aspect, the base portion 12 may include at least one transverse cross-section that is generally symmetric with respect to the central longitudinal axis of rotation L of the bullet. The cross-section may be circular. In another non-limiting embodiment or aspect, the entire base portion 12 may be generally symmetric with respect to the central longitudinal axis of rotation L of the bullet to stabilize the trajectory of the bullet.

In one non-limiting embodiment or aspect, a distal portion 20 of the base portion 12 or the entire base portion 12 may be tapered axially inwardly in a distally extending direction. As a result, the transverse cross-sectional area of the base portion 12 decreases from the proximal end 14 of the base portion 12 to the distal end 16 of the base portion 12.

In one non-limiting embodiment or aspect, the base portion 12 may include at least one transverse cross section that is solid throughout. In another non-limiting embodiment or aspect, the entire base portion 12 may be solid throughout.

The hollow nose portion 18 comprises a proximal end 22, a distal end 24, and a sidewall 26 extending between the proximal end 22 and the distal end 24. The sidewall 26 defines at least one internal cavity 28. The hollow nose portion 18 may be formed into the shape of a hollow tapered nose such that the outer surface and/or the inner surface of the sidewall 26 of the hollow nose portion 18 taper axially inwardly from the proximal end 22 to the distal end 24. As a result, the transverse cross-sectional area of the internal cavity 28 decreases from the proximal end 22 of the hollow nose portion 18, adjacent to the base portion 12, to the distal end 24 of the hollow nose portion 18 and the transverse cross-sectional area defined by the outer perimeter of the hollow nose portion 18 decreases from the proximal end 22 of the hollow nose portion 18, adjacent to the base portion 12, to the distal end 24 of the hollow nose portion 18.

In one non-limiting embodiment or aspect, a portion of the hollow nose portion 18 or the entire hollow nose portion 18 may include at least one transverse cross-section that is generally symmetric with respect to the central longitudinal axis of rotation L of the bullet. In another non-limiting embodiment or aspect, the outer surface of the hollow nose portion 18 may be symmetric with respect to the central longitudinal axis of rotation L of the bullet to stabilize the trajectory of the bullet.

In one non-limiting embodiment or aspect, the internal cavity 28 of the hollow nose portion 18 may have a cylindrical transverse cross-section. In another non-limiting embodiment or aspect, the internal cavity 28 of the hollow nose portion 18 may have a transverse cross-section that is at least partly polygonal. In yet another non-limiting embodiment or aspect, the internal cavity 28 of the hollow nose portion 18 may have a transverse cross-section that is at least partly triangular, square, hexagonal, or octagonal. A triangular, square, or polygonal internal cavity 28 may facilitate the opening of the hollow nose portion 18 in sections to form distinct petals upon expansion when entering a target, such as tissue or simulated tissue. The internal cavity 28 of the hollow nose portion 18 may be configured and modified depending on the intended use. For example, an internal cavity 28 having a smaller cross-section and shorter length may result in deeper penetration and a smaller initial wound cavity. An internal cavity 28 having a larger cross-section and longer length may result in shorter penetration and a larger initial wound cavity. In one non-limiting embodiment or aspect, the internal cavity 28 may be generally symmetric with respect to the central longitudinal axis of rotation L of the bullet to stabilize the trajectory of the bullet.

Figure 3:
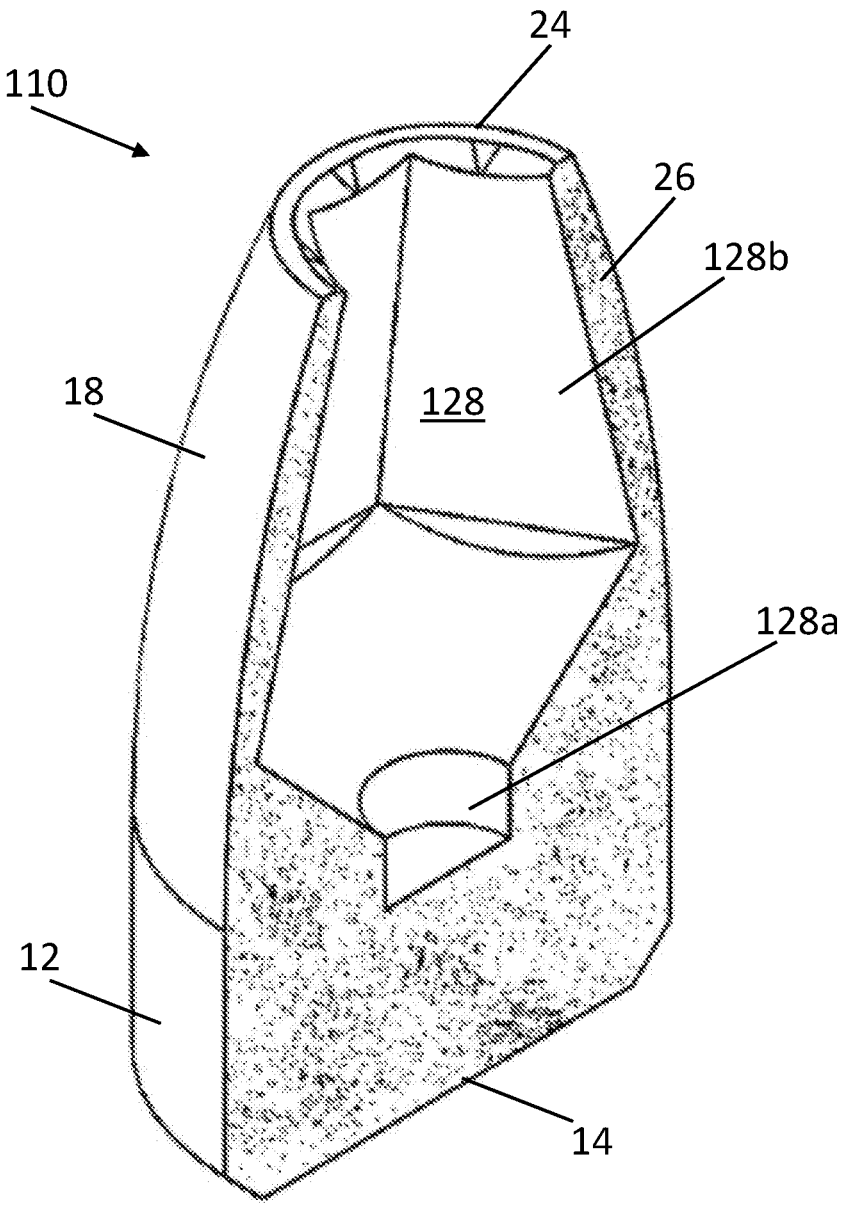
FIG. 3 is a sectional perspective view of a non-jacketed expandable bullet according to a non-limiting embodiment or aspect of the present invention.

In one non-limiting embodiment or aspect, as shown in FIG. 3, the monolithic sintered body 110 may have an internal cavity comprising a proximal portion 128*a* and a distal portion 128*b*. The proximal portion 128*a* of the internal cavity 128 may extend distally from the distal end 116 of the base portion 112 and the distal portion 128*b* of the internal cavity 128 may extend distally from the proximal portion 128*a*. In one non-limiting embodiment or aspect, the proximal portion 128*a* of the internal cavity 128 may have a transverse cross-section that is circular forming a cylindrical internal cavity 128, while the inner surface of the distal portion 128*b* may taper inwardly in a distal direction such that the transverse cross-sectional area of the distal portion 128*b* of the internal cavity 128 decreases as it approaches the distal end 124 of the hollow nose portion 118. The maximum transverse cross-sectional area of the distal portion 128*b* of the internal cavity 128 may be larger than the maximum transverse cross-sectional area of the proximal portion 128*a* of the internal cavity 128. In one non-limiting embodiment or aspect, the distal portion 128*b* may first taper outwardly in a distal direction and then taper inwardly in a distal direction.

In non-limiting embodiments or aspects, the wall thickness of the sidewall of the hollow nose portion 18 may be less than half of a maximum radius of the base portion 12, for example, less than a third of the maximum radius of the base portion 12 or less than a quarter of the maximum radius of the base portion 12. Thinner wall thickness of the hollow tapered nose 18 may facilitate an opening of the hollow tapered nose 18 upon expansion when entering a target, such as tissue or simulated tissue.

In one non-limiting embodiment or aspect, the distal end 24 of the hollow nose portion 18 may be open into the internal cavity 28 of the hollow nose portion 18. In one non-limiting embodiment or aspect, the opening may have a transverse cross-section having the same shape as the cross-section of the internal cavity 28. The opening may facilitate expansion (mushrooming) of the hollow nose portion 18 on impact, increasing the diameter of the bullet to limit penetration and/or produce a larger diameter wound for faster incapacitation. In another non-limiting embodiment or aspect, the distal end 24 of the hollow nose portion 18 may be closed.

In one non-limiting embodiment or aspect, the base portion 12 and the hollow nose portion 18 of the monolithic sintered body 10 may be integrally formed together during a sintering process that applies heat and/or pressure to a compacted powder preform to form a unitary mass of material that includes solid-solid interfaces between adjacent powder particles. The monolithic nature of the monolithic sintered body 10 may provide better rotational stability compared to non-monolithic projectiles.

In one non-limiting embodiment or aspect, the hollow nose portion 18 may be tapered using a deformation process.

In one non-limiting embodiment or aspect, the material of the monolithic sintered body 10 may be any material capable of being sintered and deformed. In one non-limiting embodiment or aspect, the material of the monolithic sintered body 10 may be lead-free. In one non-limiting embodiment or aspect, the material of the monolithic sintered body 10 may include at least one of copper, nickel, tin, zinc, or combinations thereof. In one non-limiting embodiment or aspect, the monolithic sintered body may be made from copper or a copper-based alloy. In one non-limiting embodiment or aspect, the copper-based alloy may include at least 60% copper, for example, at least 70% copper, at least 80% copper, or at least 90% copper. In another non-limiting embodiment or aspect, the copper-based alloy may include at least one of nickel, tin, zinc, or any combination thereof to activate desired toughness and ductility. The ability to vary the mechanical properties via the composition gives flexibility and versatility. For example, varying the ductility can affect the depth of penetration of the bullet, the expansion of the bullet, the fracture properties of the bullet and/or the penetration of the bullet into various surfaces. In one non-limiting embodiment or aspect, the material of the monolithic sintered body 10 may be a lead-free copper-based alloy that includes at least 70% copper and at least one of nickel, tin, zinc, or any combination thereof. In one non-limiting embodiment or aspect, the material of the monolithic sintered body 10 may be a lead-free copper-based alloy that includes at least 70% copper and the remainder zinc, for example, at least 80% copper and the remainder zinc, at least 90% copper and the remainder zinc, or at least 95% copper and the remainder zinc.

In one non-limiting embodiment or aspect, a method of manufacturing an expandable bullet includes providing a monolithic sintered body including a base portion and a hollow peripheral portion extending distally from the base portion and forming the hollow peripheral portion into a hollow tapered nose.

Figure 4A:
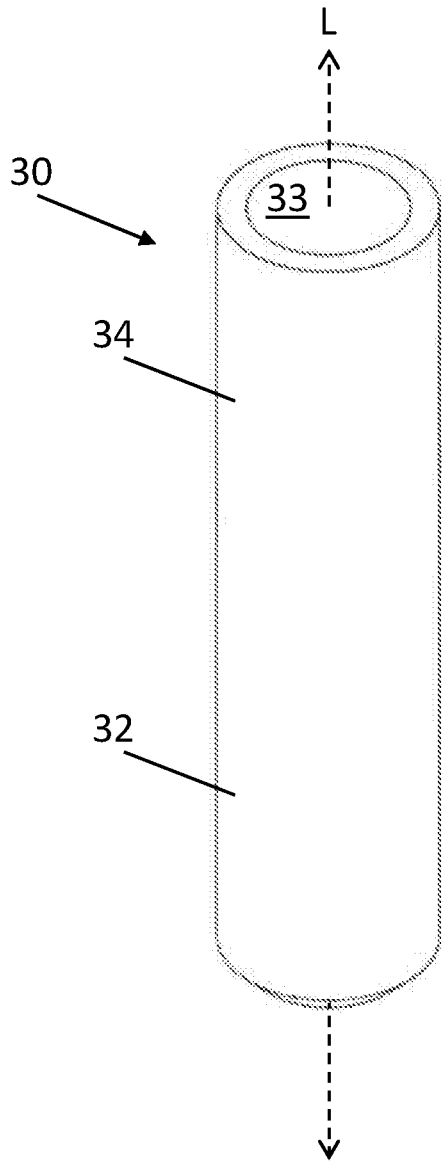
FIG. 4A is a perspective view of a monolithic sintered body with an internal cavity having a circular transverse cross-section before deformation according to a non-limiting embodiment or aspect of the present invention.
Figure 4B:
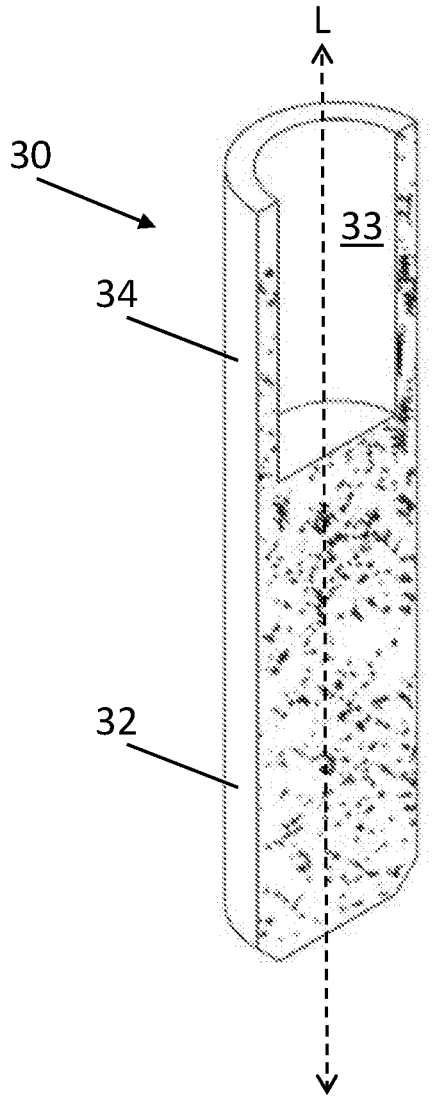
FIG. 4B is a sectional perspective view of the monolithic sintered body of FIG. 4A.

FIG. 4A shows a perspective view of a monolithic sintered body 30 including a base portion 32 and a hollow peripheral portion 34 extending distally from the base portion 32 prior to forming the hollow peripheral portion 34 into a hollow tapered nose according to one non-limiting embodiment or aspect. FIG. 4B shows a sectional perspective view of the monolithic sintered body 30 of FIG. 4A. The hollow peripheral portion 34 has an internal cavity 33 having a circular cross-section.

Figure 5A:
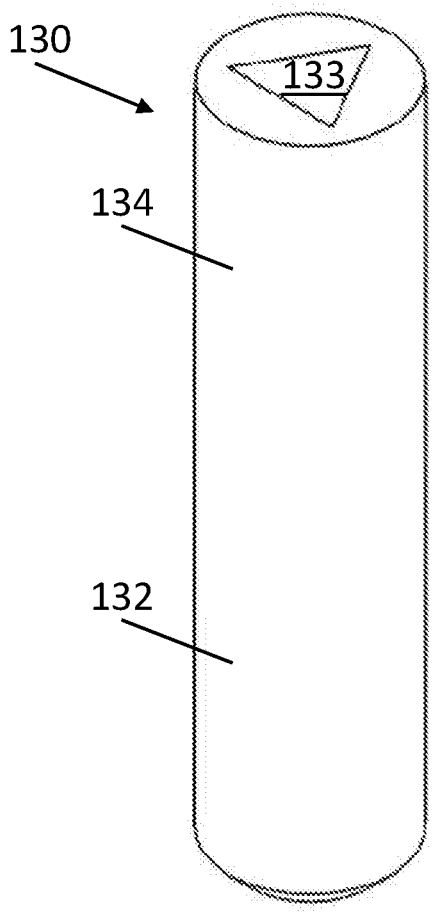
FIG. 5A is a perspective view of a monolithic sintered body with an internal cavity having a triangular transverse cross-section before deformation according to a non-limiting embodiment or aspect of the present invention.
Figure 5B:
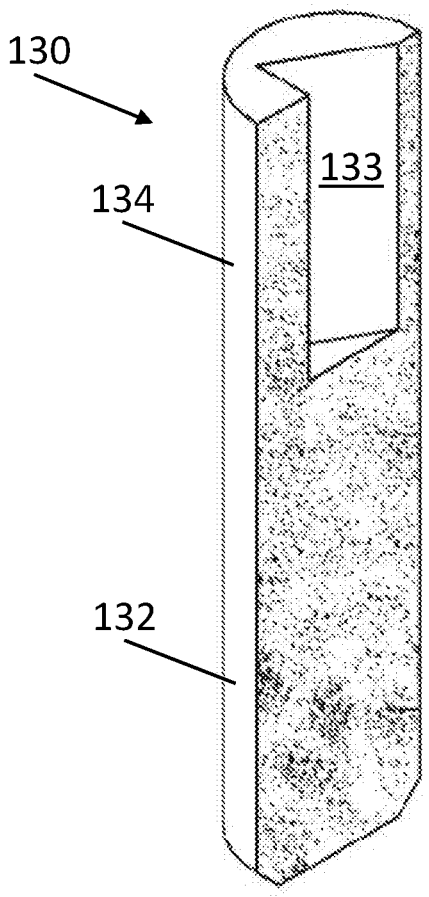
FIG. 5B is a sectional perspective view of the monolithic sintered body of FIG. 5A.

FIG. 5A shows a perspective view of a monolithic sintered body 130 including a base portion 132 and a hollow peripheral portion 134 extending distally from the base portion 132 prior to forming the hollow peripheral portion 134 into a hollow tapered nose according to one non-limiting embodiment or aspect. FIG. 5B shows a sectional perspective view of the monolithic sintered body 130 of FIG. 5A. The hollow peripheral portion 134 has an internal cavity 133 having a triangular cross-section.

Figure 6A:
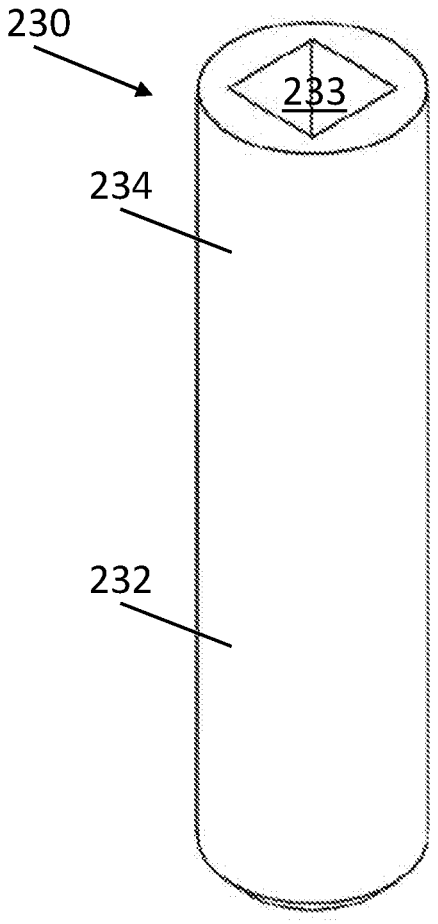
FIG. 6A is a perspective view of a monolithic sintered body with an internal cavity having a square transverse cross-section before deformation according to a non-limiting embodiment or aspect of the present invention.
Figure 6B:
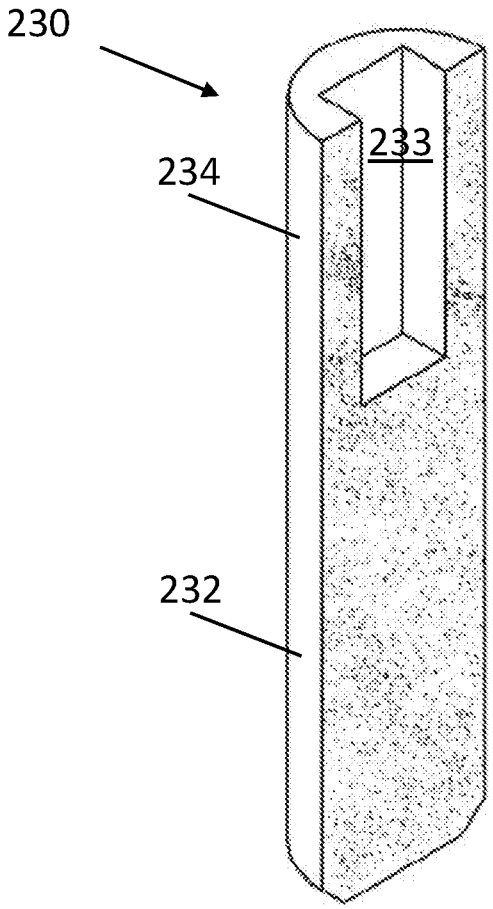
FIG. 6B is a sectional perspective view of the monolithic sintered body of FIG. 6A.

FIG. 6A shows a perspective view of a monolithic sintered body 230 including a base portion 232 and a hollow peripheral portion 234 extending distally from the base portion 232 prior to forming the hollow peripheral portion 234 into a hollow tapered nose according to one non-limiting embodiment or aspect. FIG. 6B shows a sectional perspective view of the monolithic sintered body 230 of FIG. 6A. The hollow peripheral portion 234 has an internal cavity 233 having a square cross-section.

Figure 7A:
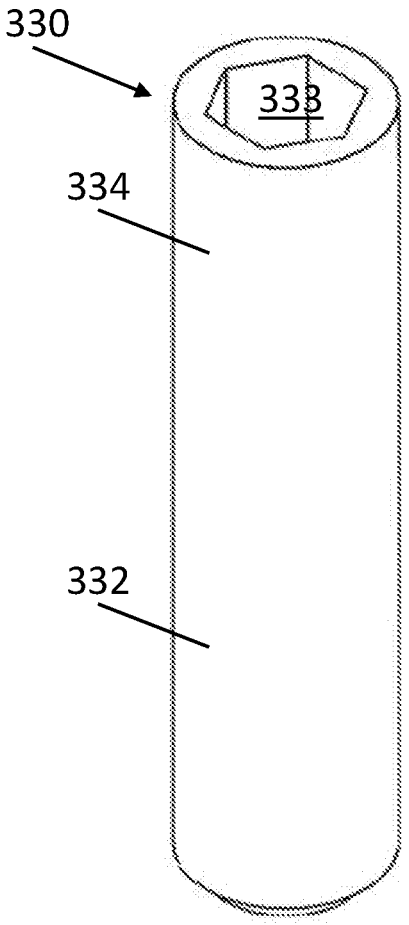
FIG. 7A is a perspective view of a monolithic sintered body with an internal cavity having a hexagonal transverse cross-section before deformation according to a non-limiting embodiment or aspect of the present invention.
Figure 7B:
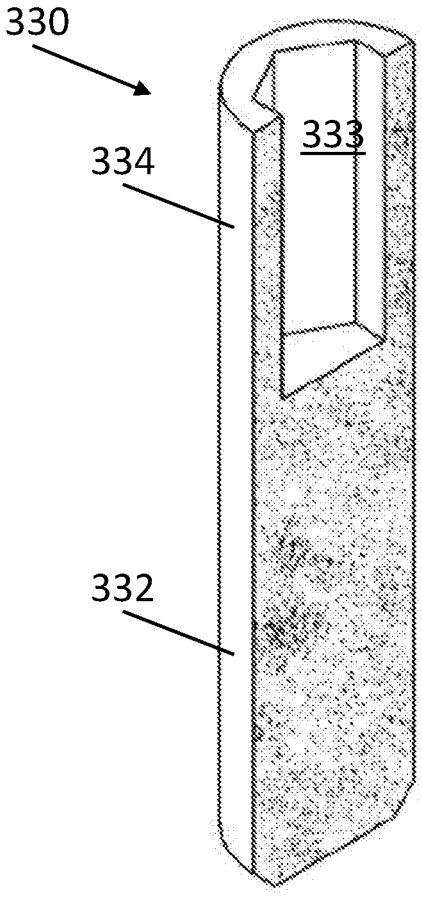
FIG. 7B is a sectional perspective view of the monolithic sintered body of FIG. 7A.

FIG. 7A shows a perspective view of a monolithic sintered body 330 including a base portion 332 and a hollow peripheral portion 334 extending distally from the base portion 332 prior to forming the hollow peripheral portion 334 into a hollow tapered nose according to one non-limiting embodiment or aspect. FIG. 7B shows a sectional perspective view of the monolithic sintered body 330 of FIG. 7A. The hollow peripheral portion 334 has an internal cavity 333 having a hexagonal cross-section.

Figure 8A:
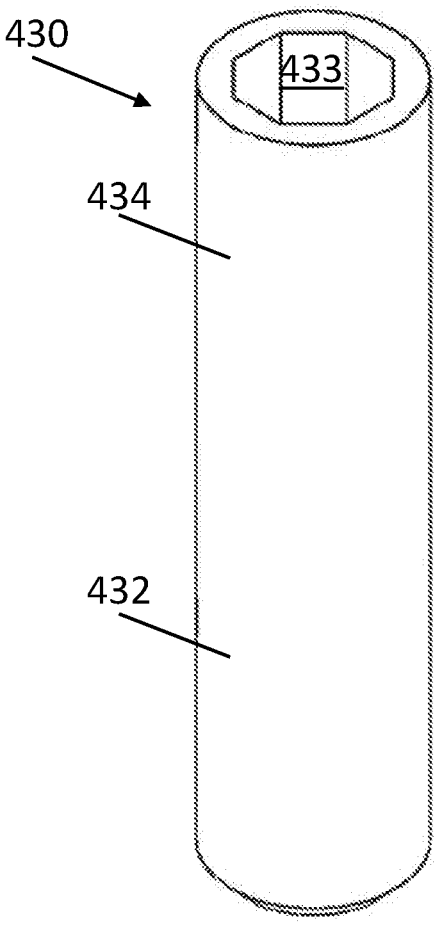
FIG. 8A is a perspective view of a monolithic sintered body with an internal cavity having an octagonal transverse cross-section before deformation according to a non-limiting embodiment or aspect of the present invention.
Figure 8B:
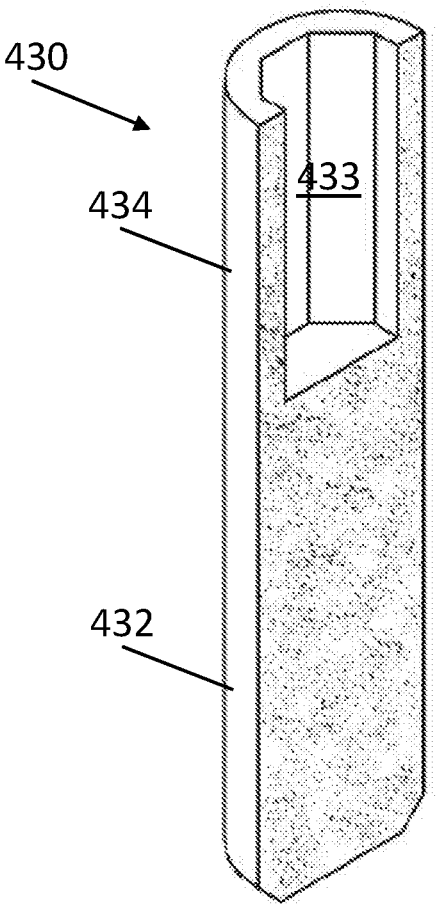
FIG. 8B is a sectional perspective view of the monolithic sintered body of FIG. 8A.

FIG. 8A shows a perspective view of a monolithic sintered body 430 including a base portion 432 and a hollow peripheral portion 434 extending distally from the base portion 432 prior to forming the hollow peripheral portion 434 into a hollow tapered nose according to one non-limiting embodiment or aspect. FIG. 8B shows a sectional perspective view of the monolithic sintered body 430 of FIG. 8A. The hollow peripheral portion 434 has an internal cavity 433 having an octagonal cross-section.

In one non-limiting embodiment or aspect, a proximal portion of the internal cavity of the hollow peripheral portion may extend distally from the distal end of the base portion and a distal portion of the internal cavity may extend distally from the proximal portion. The proximal portion may have a different transverse cross-sectional area and/or shape from the distal portion. Each of the proximal portion and the distal portion may have a transverse cross-section that is triangular, square, hexagonal, or octagonal. The maximum transverse cross-sectional area of the distal portion of the internal cavity may be larger than the maximum transverse cross-sectional area of the proximal portion of the internal cavity. The distal portion may have two sections where the first section tapers outwardly in a distally extending direction from the proximal portion 533*a* and the second section has no taper.

In one non-limiting embodiment or aspect, the proximal portion may have a transverse cross-section that is circular.

Figure 9:
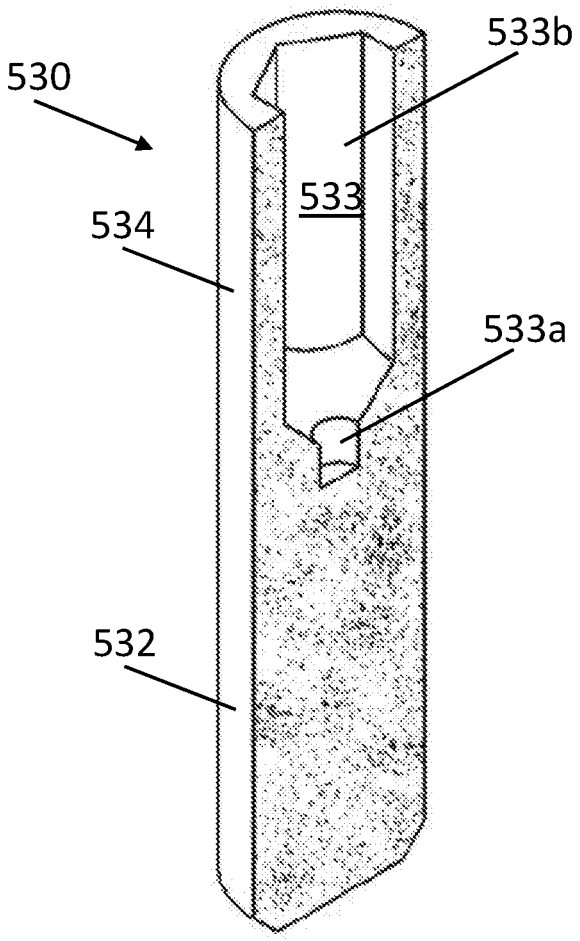
FIG. 9 is a sectional view of a monolithic sintered body with an internal cavity having two portions before deformation according to a non-limiting embodiment or aspect of the present invention.

FIG. 9 shows a sectional view of a monolithic sintered body 530 including a base portion 532 and a hollow peripheral portion 534 extending distally from the base portion 532 prior to forming the hollow peripheral portion 534 into a hollow tapered nose according to one non-limiting embodiment or aspect. The proximal portion 533*a* of the internal cavity 533 has a transverse cross-section that is circular, while the transverse cross-section of the distal portion 533*b* of the internal cavity 533 is hexagonal. The maximum transverse cross-sectional area of the distal portion 533*b* of the internal cavity 533 is larger than the maximum transverse cross-sectional area of the proximal portion 533*a* of the internal cavity 533. The distal portion 533*b* has two sections where the first section tapers outwardly in a distally extending direction from the proximal portion 533*a* and the second section has no taper.

In one non-limiting embodiment or aspect, a portion of the distal end of the base portion 32 may have a constant outside diameter or may taper axially inwardly in a distally extending direction.

In one non-limiting embodiment or aspect, the hollow peripheral portion 34 may have an outer surface with a constant outside diameter or an outer surface that tapers axially inwardly in a distally extending direction.

In one non-limiting embodiment or aspect, the hollow peripheral portion 34 may have an inner surface with a constant inside diameter or an inner surface that tapers axially inwardly in a distally extending direction.

In one non-limiting embodiment or aspect, the hollow peripheral portion 34 may be formed into the shape of a hollow tapered nose by a deformation process. In one preferred and non-limiting embodiment or aspect, the entire hollow peripheral portion 34 may be formed into the shape of a hollow tapered nose by a deformation process. In one non-limiting embodiment or aspect, the hollow peripheral portion 34 and a portion of the base portion 32 may be formed into a hollow tapered nose, as shown in FIGS. 1 and 2, by a deformation process.

In one non-limiting embodiment or aspect, the method of manufacturing an expandable bullet may include providing powder to a cavity formed in a die between at least an upper punch and a lower punch to form a compacted powder preform including a base portion and a hollow peripheral portion extending distally from the base portion. In one non-limiting embodiment or aspect, the powder may be any material capable of being sintered and deformed. In one non-limiting embodiment or aspect, the powder may be selected from gas atomized powder or water atomized powder. In one non-limiting embodiment or aspect, the powder may be lead free. In one non-limiting embodiment or aspect, the powder may comprise at least one of copper, nickel, tin, zinc, or combinations thereof. In one non-limiting embodiment or aspect, the powder may comprise copper or a copper-based alloy. In one non-limiting embodiment or aspect, the copper-based alloy powder may include at least 60% copper, for example, at least 70% copper, at least 80% copper, or at least 90% copper. In another non-limiting embodiment or aspect, the copper-based alloy powder may include at least one of nickel, tin, zinc, or any combination thereof to activate desired toughness and ductility. In one non-limiting embodiment or aspect, the powder may comprise a lead-free copper-based alloy that includes at least 70% copper and at least one of nickel, tin, zinc, or any combination thereof. In one non-limiting embodiment or aspect, the lead-free copper-based alloy that includes at least 70% copper and the remainder zinc, for example, at least 80% copper and the remainder zinc, at least 90% copper and the remainder zinc, or at least 95% copper and the remainder zinc. As an example, the powder may be water atomized Accu-powder 165A, which comprises 95% copper and a remainder of zinc with a particle size of 20-100 μm. The ability to vary the mechanical properties via the composition gives flexibility and versatility. For example, varying the ductility can affect the depth of penetration of the bullet, the expansion of the bullet, the fracture properties of the bullet, and/or the penetration of the bullet into various surfaces.

Particle size of the constituent powder can be at least 5 μm and up to 500 μm, for example, 5-500 μm, 20-300 μm, or 20-100 μm.

In one non-limiting embodiment or aspect, the powder may be mixed with a lubricant to allow the powder particles to move relative to other particles and relative to tooling. For example, atomized wax may be used, such as Acrawax A. At least 0.2 wt. % and up to 2.0 wt. % of the lubricant may be provided, for example, 0.2-2.0 wt. %, 0.2-1.0 wt. %, or 0.5 wt. %. The lubricant may be blended together in a conical blender for 20 minutes to allow for homogenization.

Figure 10:
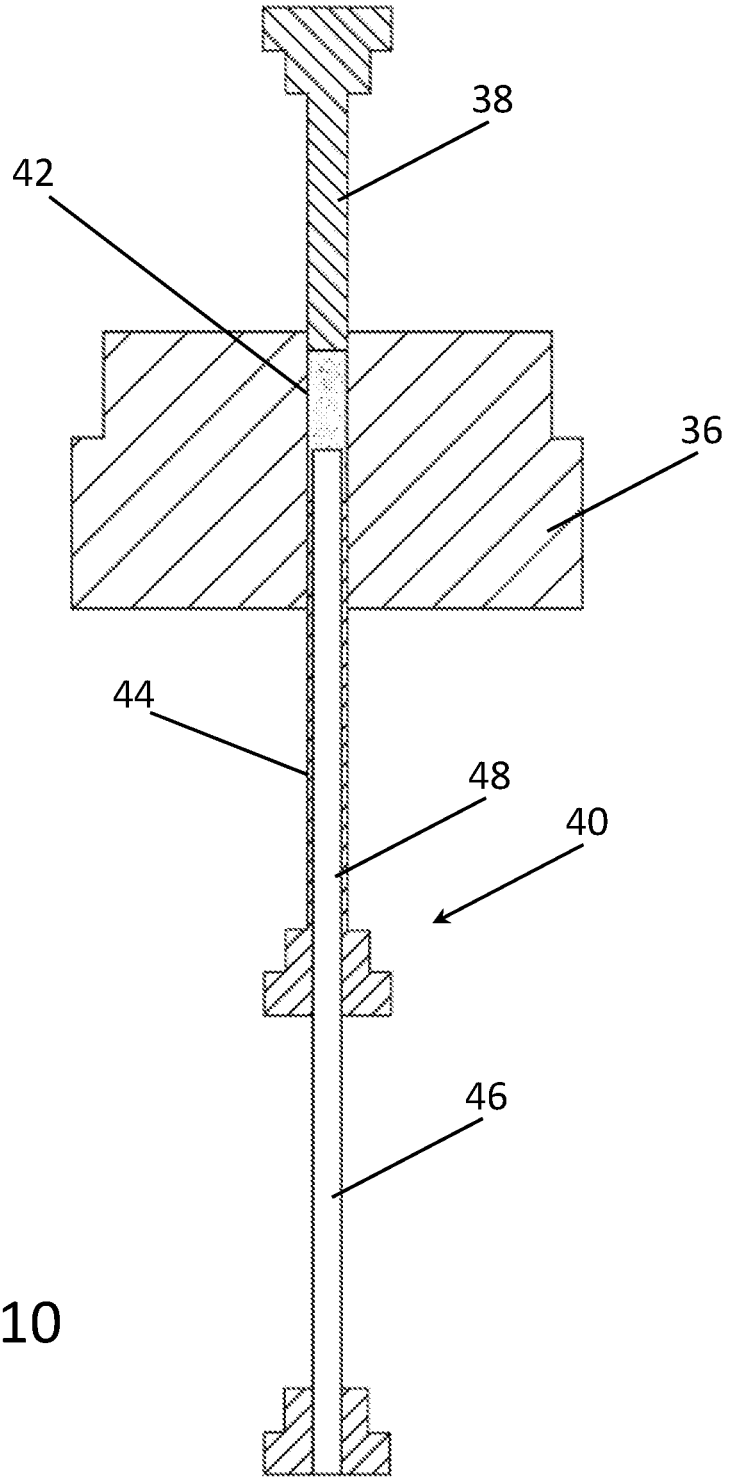
FIG. 10 is a sectional view of tooling for forming a compacted powder preform according to a non-limiting embodiment or aspect of the present invention.
Figure 11:
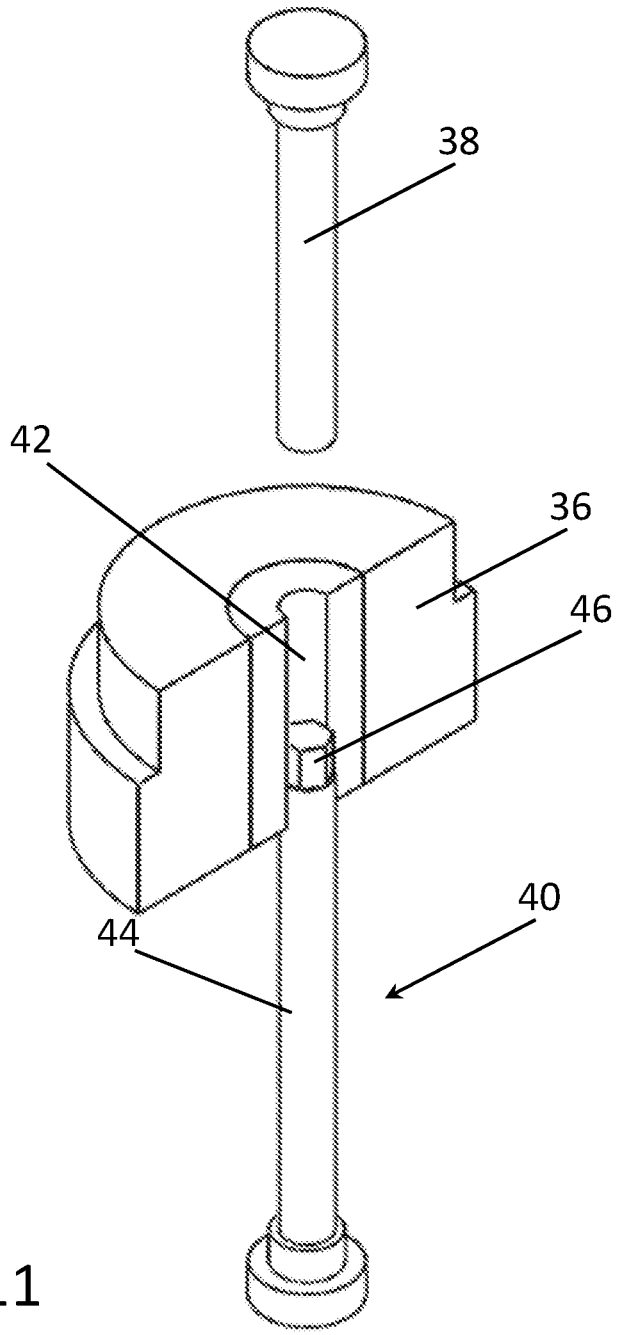
FIG. 11 is a sectional perspective view of tooling for forming a compacted powder preform according to another non-limiting embodiment or aspect of the present invention.

In one non-limiting embodiment or aspect, FIGS. 10 and 11 show sectional views of tooling for forming a compacted powder preform. The tooling may include a die 36, an upper punch 38, and a lower punch 40, 140 having two sections. The die 36 may include an internal through-hole 42 which may be cylindrical. The transverse cross-sectional area of the through-hole 42 may be uniform. A lower end of the upper punch 38 may have a size and shape corresponding to a size and shape of an upper portion of the through-hole 42 of the die 36 such that the lower end of the upper punch 38 can fit into the through-hole 42 of the die 36 while not allowing powder to pass between the die 36 and the upper punch 38. The size and shape of the through-hole of the die 36 and the size and shape of the lower end of the upper punch 38 may correspond to the desired size and shape of the base portion of the compacted powder preform.

The first section 44 of the lower punch 40 may have a size and shape corresponding to a size and shape of the lower portion of the through-hole 42 of the die 36 such that the first section 44 of the lower punch 40 can fit into the through-hole 42 of the die 36 while not allowing powder to pass between the die 36 and the first portion 44 of the lower punch 40. The second section 46 of the lower punch 40 has a size and shape corresponding to the size and shape of the internal cavity that is desired in the hollow peripheral portion of the compacted powder preform. For example, the second section 46 of the lower punch 40 has a transverse cross-section that is triangular, square, hexagonal, or octagonal.

In one non-limiting embodiment or aspect, the second section 46 of the lower punch 40 may comprise two portions each having a different transverse cross-sectional area and/or shape in order to form a bullet having an internal cavity with two portions as described above. Each of the first portion and the second portion may have a transverse cross-section that is triangular, square, hexagonal, or octagonal. The maximum transverse cross-sectional area of the distal portion of the internal cavity may be larger than the maximum transverse cross-sectional area of the proximal portion of the internal cavity. The second portion may have two sections where the first section tapers outwardly in a distally extending direction from the first portion and the second section has no taper.

Figure 12:
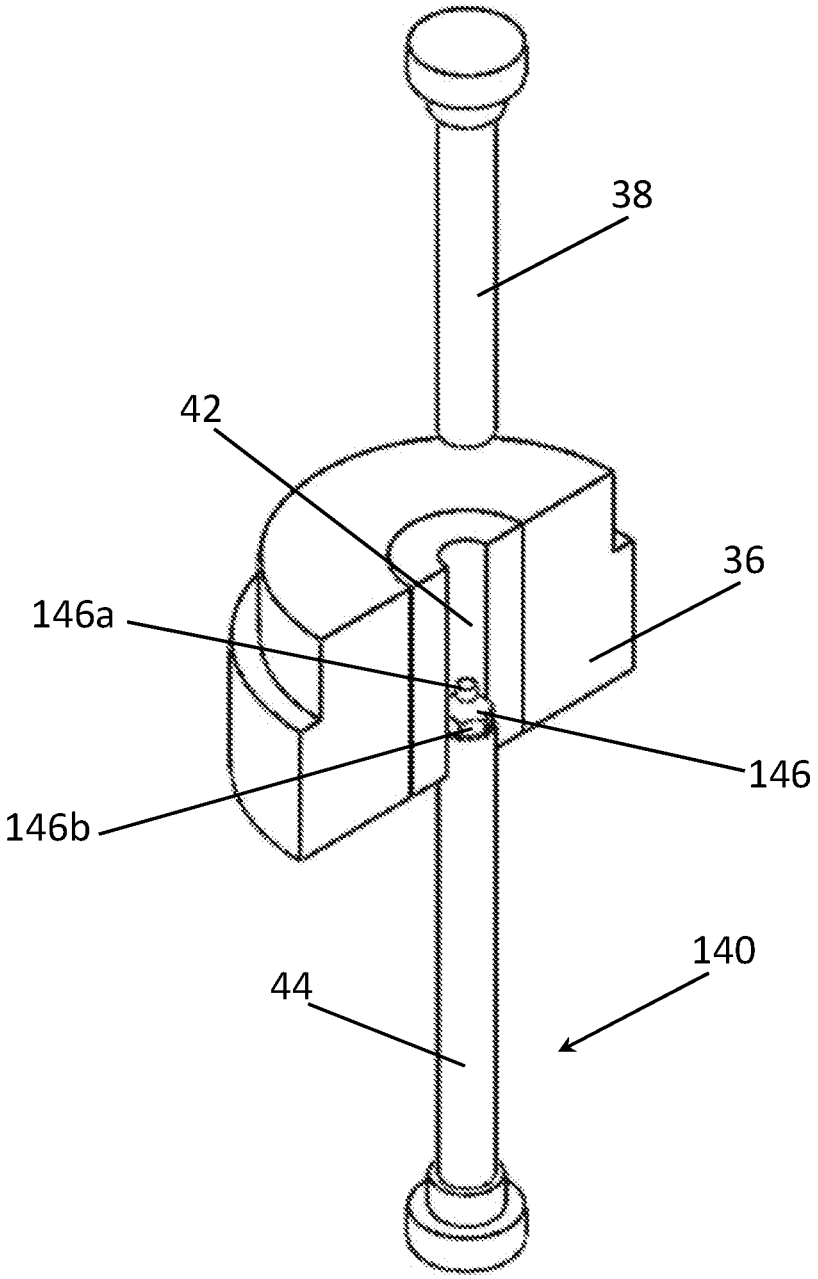
FIG. 12 is a sectional perspective view of tooling for forming a compacted powder preform according to another non-limiting embodiment or aspect of the present invention.

In one non-limiting embodiment or aspect, FIG. 12 shows tooling where the second section 146 of the lower punch 140 has portions. The first portion 146*a* has a circular transverse cross-section and the second portion 146*b* has a hexagonal transverse cross-section. The second portion 146*b* includes a section that tapers outwardly in a distally extending direction from the first portion 146*a*.

The first section 44 of the lower punch 40 and the second section 46 of the lower punch 44 may be separate from one another or may be integral.

In one non-limiting embodiment or aspect shown in FIG. 10, the second section 46 of the lower punch 40 passes through an internal passageway 48 in the first section 44 of the lower punch 40 and extends distally beyond the distal end of the first section 44 of the lower punch 40. The second section 46 of the lower punch 40 has a circular transverse cross-section forming a cylindrical internal cavity in the hollow peripheral portion of the compacted powder preform.

In another non-limiting embodiment or aspect shown in FIG. 11, the second section 46 of the lower punch 40 is integral with the first section 44 of the lower punch 40 and has a hexagonal transverse cross-section forming an internal cavity having a hexagonal transverse cross-section in the hollow peripheral portion of the compacted powder preform as shown in FIGS. 7A and 7B.

In either embodiment or aspect, the sidewall of the hollow peripheral portion of the compacted powder preform is formed between the top surface of the first section 44 of the lower punch 40, the outer surface of the second section 46 of the lower punch 40, and the inner surface of the through-hole 42 of the die 36. The base portion of the compacted powder preform is formed between the bottom surface of the upper punch 38, the top surface of the second portion 46 of the lower punch 40, and the inner surface of the through-hole 42 of the die 36. In one non-limiting embodiment or aspect, the first section 44 and the second section 46 of the lower punch 40 may be separate pieces as shown in FIG. 10. In another non-limiting embodiment or aspect, the first section 44 and the second section 46 of the lower punch 40 may be integral as shown in FIG. 11. In yet another non-limiting embodiment or aspect, the second section 46 of the lower punch 40 may be in a sliding relationship with the first section 44 of the lower punch 40.

In one non-limiting embodiment or aspect, the die 36 and the upper punch 38 may be made of tool steel. In another non-limiting embodiment or aspect, the die 36, the upper punch 38, and the lower punch 40 may be made of tool steel.

In one preferred and non-limiting embodiment or aspect, the through-hole 42 in the die 36 may be a cylindrical cavity.

To form the compacted powder preform, powder may be provided to the cavity formed by the die 36, the bottom end of the upper punch 38, and the top end of the lower punch 40, and at least the upper punch 38 may be pressed to compact the powder. In one preferred and non-limiting embodiment or aspect, the powder may be compacted to form the compacted powder preform by moving the upper punch 38 and/or the lower punch 40 into the through-hole 42 of the die 36 such that the powder is compacted between the upper punch 38 and the lower punch 40. In one non-limiting embodiment or aspect, the upper punch 38 may enter the die 36 and exert 20-60 tons per square inch of pressure onto the powder. In one preferred and non-limiting embodiment or aspect, the tooling may be placed in a uniaxial compaction press such as a 30 ton Gasbarre mechanical press.

After compaction, the compacted powder preform (green preform) may be ejected via the lower punch 40 and placed in a sintering furnace.

In one preferred and non-limiting embodiment or aspect, the compacted powder preform may be heated to a temperature below the melting point of its main constituent for a time sufficient to form and grow necks between adjacent powder particles such that sufficient ductility is provided for a subsequent step where the hollow peripheral portion and, optionally, a portion of the base portion is deformed into the shape of a hollow tapered nose.

In one non-limiting embodiment or aspect, the time and temperature of sintering may be adjusted to adjust the desired mechanical properties of the bullet. In one non-limiting embodiment or aspect, the sintering temperature may be at least 1500° F. and at most 2000° F., for example, 1500-2000° F., 1600-2000° F., or 1600-1950° F. However, other conditions, such as composition of the compacted powder preform, may require sintering temperatures outside of 1500° F. and 2000° F. In one non-limiting embodiment or aspect, the compact may be heated to a final sintering temperature of about 1900° F. and held for about 60 minutes.

By way of non-limiting examples, Table 1 shows the sintering temperatures for four brass powders comprising copper and zinc and a copper powder.

TABLE 1

| Copper (wt. %) | Zinc (wt. %) | Sintering Temperature (° F.) |
|---|---|---|
| 70 | 30 | 1620 |
| 80 | 20 | 1670 |
| 90 | 10 | 1800 |
| 95 | 5 | 1900 |
| 100 | 0 | 1950 |

In one non-limiting embodiment or aspect, the compacted powder preform may be sintered in a non-oxidizing or reducing atmosphere, for example, a vacuum atmosphere or a gas atmosphere comprising nitrogen, hydrogen, inert gases, or mixtures thereof.

In one non-limiting example, the compacted powder preform is sintered in a belt feed sintering furnace with a controlled temperature profile and reducing atmosphere. For example, an Abbott furnace company 4 zone 20" sintering furnace may be used. The atmosphere may be a nitrogen-hydrogen mix with varied gas flows of nitrogen and hydrogen at various points in the furnace.

In one preferred and non-limiting embodiment or aspect, the method of manufacturing an expandable bullet may include deforming the hollow peripheral portion 34 of the monolithic sintered body 30 into the shape of a hollow tapered nose and/or reduce the porosity of the hollow peripheral portion 34, such as by a mechanical deformation in a sizing/forming press.

In one non-limiting embodiment or aspect, a deformation process may be further applied to the base portion 32 to shape the base portion 32 and/or to reduce porosity of the base portion 32.

Figure 13:
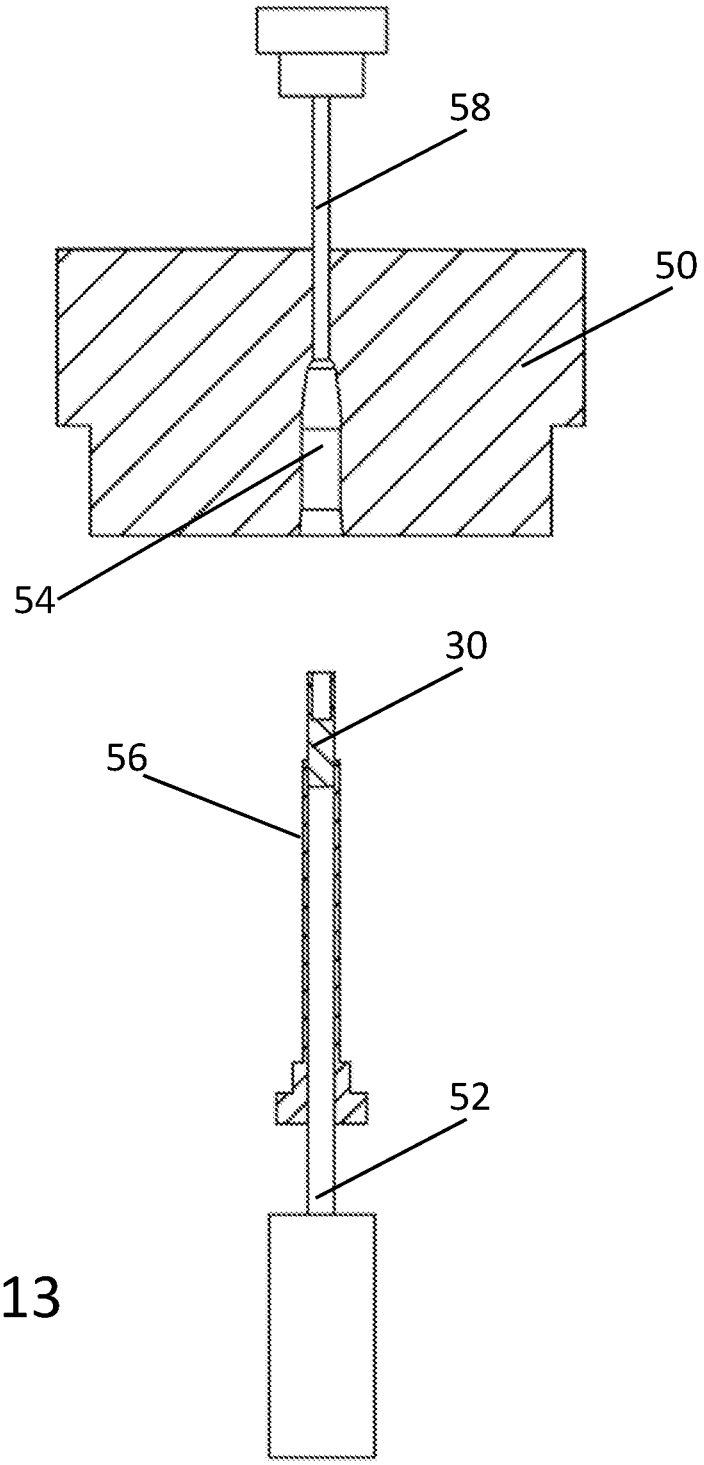
FIG. 13 is a sectional view of a sizing/forming press according to a non-limiting embodiment or aspect of the present invention.

According to one non-limiting embodiment or aspect, FIG. 13 shows a sectional view of a sizing/forming press for forming the hollow peripheral portion 34, and, optionally, a portion of the base portion 32 into the shape of a hollow tapered nose. The sizing/forming press may include a die 50 and a punch 52. The die 50 has an internal cavity 54 having a shape corresponding to the desired shape of the final monolithic sintered body. In one non-limiting embodiment or aspect, the die 50 may have a cylindrical cavity with a tapered, generally conical end to give the monolithic sintered body 30 its final shape, including a hollow tapered nose portion, while retaining the internal cavity of the monolithic sintered body 30.

The monolithic sintered body 30 is placed into the internal cavity 54 of the die 50 and the punch 52 is inserted into the internal cavity 54 of the die, thereby forcing the monolithic sintered body 30 to deform and contour to the shape of the internal cavity 54 of the die 50. The transverse cross-sectional area of the outer surface of the hollow nose portion 18 is only minimally changed at the proximal end 22, but is reduced significantly at the distal end 24, thereby closing or nearly closing the distal end 24 of the hollow nose portion 18. The shape of the internal cavity 28 of the hollow nose portion 18 after deformation is determined by the shape of the hollow peripheral portion 34 of the monolithic sintered body 30 prior to forming. When the transverse cross-section of the hollow peripheral portion 34 of the monolithic sintered body 30 prior to forming is triangular, square, hexagonal, or octagonal, the inner surface of the hollow peripheral portion 34 folds inwardly during the deformation such that the inner surface of the internal cavity 28 of the monolithic sintered body 30 after deformation may have portions that taper outwardly in a distal direction and portions that taper inwardly in a distal direction. The combination of the shape of the internal cavity 33 of the hollow peripheral portion 34 and the deformation of the hollow peripheral portion 34 provides a non-jacketed expandable bullet having a cavity with a unique shape that is larger than prior art non-jacketed expandable bullets.

In one non-limiting embodiment or aspect, the deformation of the hollow peripheral portion 34 into the shape of a hollow tapered nose restrikes the outside dimension and also forms the conical nose (ogive) of the bullet while maintaining the internal hollow cavity for increased expansion.

In one preferred and non-limiting embodiment or aspect, FIG. 13 further illustrates a holder 56 for holding the monolithic sintered body 30 during insertion of the monolithic sintered body 30 and the punch 52 into the die 50. In another non-limiting embodiment or aspect, FIG. 13 further illustrates a pin 58 for facilitating the release of the monolithic sintered body 30 from the die 50 after forming the hollow peripheral portion 34 into the shape of a hollow tapered nose.

After the monolithic sintered body 30 is released from the die 50, the monolithic sintered body 30 may be deburred, such as by vibratory or rotary deburring, to remove burrs, polish the edges, and ready the bullet for loading into ammunition.

In one non-limiting embodiment or aspect, the bullet may have a porosity of between about 2 to about 20%. For example, in the green state, the compacted powder preform may have a porosity of about 20%. In the sintered state, the monolithic sintered body may have a porosity of about 15%. After deformation, the bullet may have a porosity of about 7%. It is believed that, as the monolithic sintered body is deformed, large pores may collapse and the density of the part may increase.

In one non-limiting embodiment or aspect, ammunition is provided, which may include a non-jacketed expandable bullet according to one or more embodiments or aspects described above and a cartridge casing holding the non-jacketed bullet. In another non-limiting embodiment or aspect, the ammunition may further include a priming compound and/or gunpowder.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the description. For example, it is to be understood that the present invention contemplates that, to the extent possible, one or more features of any embodiment can be combined with one or more features of any other embodiment.

The invention claimed is:

1. A bullet, comprising:

a monolithic sintered body comprising:

(1) a base portion having a proximal end and a distal end; and (2) a deformed hollow nose portion extending distally from the distal end of the base portion, wherein the bullet is non-jacketed and expandable, and the deformed hollow nose portion is ductile and, upon impact, the deformed hollow nose portion expands to form distinct petals that fold over such that the bullet has a mushroom shape after impact.

2. The bullet of claim 1, wherein the deformed hollow nose portion comprises a proximal end, a distal end, and a sidewall between the proximal end and the distal end.

3. The bullet of claim 2, wherein the sidewall defines an internal cavity and at least a portion of an inner surface of the internal cavity tapers inwardly in a direction extending from the proximal end of the deformed hollow portion toward the distal end of the deformed hollow portion.

4. The bullet of claim 2, wherein the sidewall defines an internal cavity and at least a portion of an inner surface of the internal cavity tapers outwardly in a direction extending from the proximal end of the deformed hollow portion toward the distal end of the deformed hollow portion.

5. The bullet of claim 1, wherein the monolithic sintered body is lead free.

6. The bullet of claim 1, wherein the monolithic sintered body includes at least one of copper, nickel, tin, zinc, or any combination thereof.

7. The bullet of claim 1, wherein the monolithic sintered body is made from copper or a copper-based alloy.

8. The bullet of claim 7, wherein the copper-based alloy includes at least 60% copper.

9. The bullet of claim 7, wherein the copper-based alloy includes at least one of nickel, tin, zinc, or any combination thereof.

10. Ammunition, comprising:

a bullet according to claim 1; and a cartridge casing holding the non-jacketed bullet.

11. A method of manufacturing a bullet, the method comprising:

providing a monolithic sintered body comprising:

(1) a base portion having a proximal end and a distal end; and (2) a hollow peripheral portion extending distally from the distal end of the base portion; and forming the hollow peripheral portion into a shape of a hollow tapered nose, wherein the bullet is non-jacketed and expandable, and the hollow tapered nose is ductile and, upon impact, the hollow tapered nose expands to form distinct petals that fold over such that the bullet has a mushroom shape after impact.

12. The method of claim 11, wherein providing the monolithic sintered body comprises:

providing a compacted powder preform comprising:

a base portion having a proximal end and a distal end; and a hollow peripheral portion extending distally from the distal end of the base portion; and sintering the compacted powder preform.

13. The method of claim 12, wherein providing the compacted powder preform includes:

providing a powder to a cavity formed in a die between at least an upper punch and a lower punch; and pressing the upper and lower punches together to compact the powder.

14. The method of claim 11, wherein the hollow peripheral portion comprises a first end, a second end, and a sidewall between the first end and the second end.

15. The method of claim 14, wherein the sidewall defines an internal cavity and at least a portion of the internal cavity has a transverse cross-section that is one of triangular, square, hexagonal, or octagonal.

16. The method of claim 11, wherein the monolithic sintered body is lead free.

17. The method of claim 11, wherein the monolithic sintered body includes at least one of copper, nickel, tin, zinc, or any combination thereof.

18. The method of claim 11, wherein the monolithic sintered body is made from copper or a copper-based alloy.

19. The method of claim 18, wherein the copper-based alloy includes at least 60% copper.

20. The method of claim 18, wherein the copper-based alloy includes at least one of nickel, tin, zinc, or any combination thereof.

* * * * *